US005134760A

United States Patent [19]

Etzion

[11] Patent Number: 5,134,760

[45] Date of Patent: Aug. 4, 1992

[54] METHOD OF FORMING AN ORNAMENT

[76] Inventor: Rafael Etzion, 15 Henhawk Rd., Great Neck, N.Y. 11024

[21] Appl. No.: 788,494

[22] Filed: Nov. 6, 1991

[51] Int. Cl.[5] ..... D04D 9/02

[52] U.S. Cl. ..... 28/147; 223/46

[58] Field of Search ..... 28/147, 140, 142, 143; 223/46, 44; 428/4, 5, 121, 126

[56] References Cited

U.S. PATENT DOCUMENTS

| | | | |
|---|---|---|---|
| 2,012,058 | 8/1935 | Shaw | 206/46 |
| 2,539,372 | 1/1951 | Metzler | 164/17 |
| 2,587,502 | 2/1952 | McMahon | 28/147 |
| 2,819,657 | 1/1958 | Hammerstrom | 93/1 |
| 2,845,736 | 8/1958 | Crawford | 41/10 |
| 3,331,105 | 7/1967 | Gordon | 24/16 |
| 3,572,396 | 3/1971 | Hoffman et al. | 138/178 |
| 3,837,972 | 9/1974 | Schuster | 156/466 |
| 4,528,217 | 7/1985 | Spathis et al. | 223/46 |
| 4,910,051 | 3/1990 | Pickering et al. | 223/46 |

*Primary Examiner*—Werner H. Schroeder
*Assistant Examiner*—Amy Brooke Vanatta
*Attorney, Agent, or Firm*—Robin, Blecker, Daley & Driscoll

[57] ABSTRACT

A method of forming ornament elements in which a piece of material has its lateral ends folded over to form a tube of material and the tube is cut at positions along and transverse to the tube axis to form loop elements. Each loop element is then creased or folded to provide an ornament element.

19 Claims, 2 Drawing Sheets

METHOD OF FORMING AN ORNAMENT

BACKGROUND OF THE INVENTION

This invention relates to a method of fabricating an ornament and, in particular, to a method of fabricating an ornament from a plurality of elements.

In the present manufacture of bow-like ornaments, it is customary to assemble the bow from a plurality of elements each in the form of a loop of material. Each loop of material is formed from an individual narrow strip of material which is cut from a roll whose width is equal to the width dimension desired for the loop, i.e., the desired dimension of the loop along the loop axis. The length of each strip, in turn, is at least equal to the circumference dimension desired of the loop.

A loop is formed by bringing the lateral ends of the strip of material together and then joining the ends by stapling, stitching, gluing or tying. In some cases, the ends might be simultaneously joined to the loop part opposing the part containing the ends.

To complete the ornament element, a loop so formed is collapsed so that the opposing loop parts are in proximity, the connected loop ends are situated centrally and the edges of the loop parts are in alignment. The opposing loop parts are then together folded or creased in one or more folds and secured centrally to hold the folds. This completes the ornament element and the completed element can then be used with other elements to form an ornament.

Assembly of an ornament is generally accomplished by abutting the secured central regions of the creased loop elements. A decorative tie is then wrapped around the abutting central regions to form the ornament. A further second type of loop element having a creased central region and elongated tails extending from the central region might also be abutted and tied with the loop elements to give an additional ornamental effect.

While the above method of forming an ornament has been used for many years, the need to cut individual strips of material and form them into loops is time consuming and labor intensive. This is aggravated by the fact that in forming each loop, the loop ends must be centrally situated and the edges of the opposing loop parts carefully aligned. Thus, manufacturers of ornaments have been looking for alternative methods which require less time and labor.

It is, therefore, a primary object of the present invention to provide a method for forming ornaments which does not suffer from the above disadvantages.

It is a further object of the present invention to provide a method for forming ornaments in which the ornament elements are more efficiently formed.

SUMMARY OF THE INVENTION

In accordance with the principles of the present invention, the above and other objectives are realized in a method in which a plurality of ornament elements are formed from a piece of material by folding the lateral ends of the material over to form a tube of material and then cutting the tube at one or more positions along and transverse to the axis of the tube. In this way, a plurality of loops of material can be formed without having to process individual material strips. This reduces the time and manpower needed to form the loops.

Once the loops are formed, opposing loop parts of each loop are then creased or folded to form each loop into a completed ornament element. These elements are then assembled by abutting and securing adjacent central regions of the elements to form an ornament.

A variety of alternative techniques are also described for holding the lateral ends of the material together during tube formation and loop formation.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
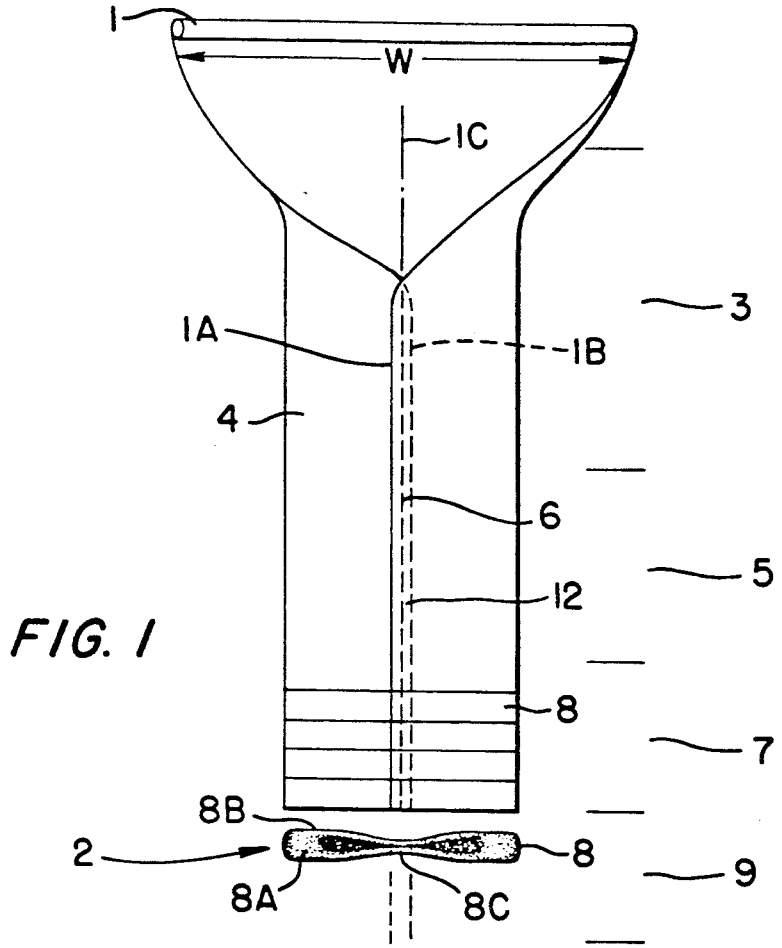
FIG. 1 shows diagrammatically the steps of forming ornament elements in accordance with the principles of the present invention.

In FIG. 1, a roll of material 1 is to be used to form ornament elements which can be assembled into an ornament. The material 1 can be any type of material conventionally used for present day ornaments. A typical material might be a vinyl backed felt material used to form bow-like ornaments.

The width W of the material 1 is selected such that it can at least accommodate the total circumference desired of the resultant ornament elements 2 which, as will be described below, are formed as loops. The material 1 is passed through a first processing station 3 wherein the lateral ends 1A and 1B of the material 1 are brought together into proximate relationship at a central location.

As shown, there is a slight overlap between the ends 1A and 1B relative to the central axis 1C of the material 1 so as to facilitate attachment of the ends one to the other. The loop ends, however, need not be overlapping but could be abutting or even slightly spaced, depending upon the mode of attachment of the ends.

When passing from the station 3, the material 1 is thus in the form of a tube 4 having substantially centrally located ends 1A and 1B. The tube 4 is conveyed through a securing station 5 in which these ends are then secured. In the case shown, the ends are secured by stitching 6 applied in the overlap region 12. Alternatively, the ends could have been glued, stapled or secured in any other conventional manner.

Also, in the case shown, the tube ends 1A and 1B are not only stitched to each other but to the opposing back part of the tube. This adds to the overall physical integrity of the loop elements when they are in completed form.

To facilitate the tube end securing process and the overall element formation, the tube 4 is preferably in collapsed form as it is being processed. This can be accomplished in the tube forming section 3 by forming a narrow tube or in the front end of the securing section 4 by rollers or some other type of collapsing mechanism.

After passing through the securing station 5, the tube 4 is then passed through a cutting station 6 wherein the tube is cut at positions transverse to and along the length of the tube axis. This results in the formation of a plurality of loop elements 8.

The loop elements 8 are then conveyed through a further processing station 9. In the station 9, the opposing loop parts 8A and 8B of each loop element are together double creased or folded centrally. To maintain the creased condition, the folds are held together by a securing means 8C such as, for example, a staple which is placed through the central folds. This completes the formation process and results in the ornament element 2.

Figure 2B:
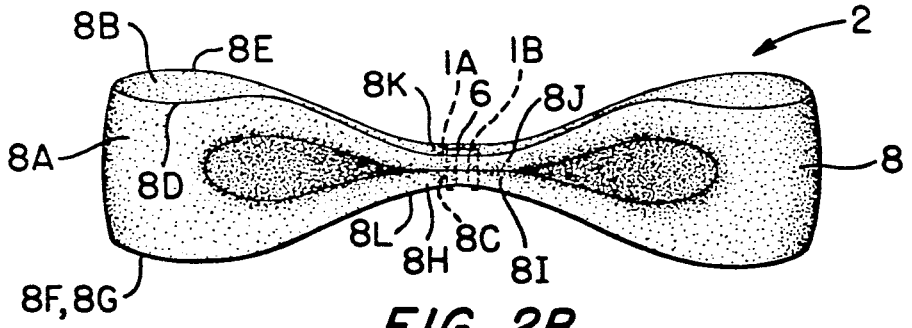
FIGS. 2A and 2B show views of an ornament element formed in accordance with the steps of FIG. 1.
Figure 2A:
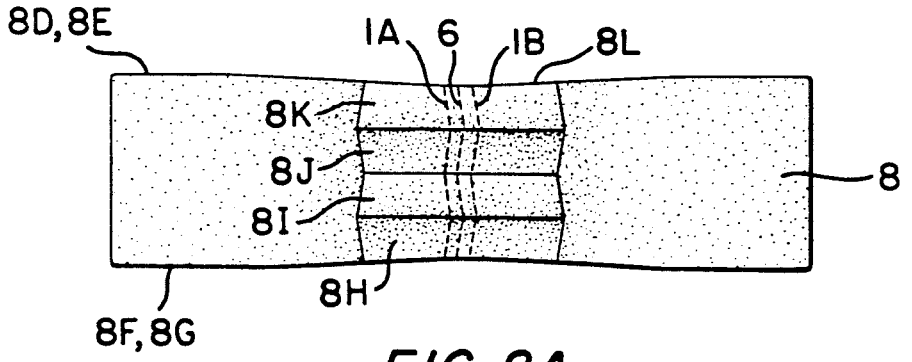

FIGS. 2A and 2B illustrate an enlaraged view of the element 8 in partially and completely folded condition. As can be seen, the element 8 comprises opposing front and back loop parts 8A and 8B. These loop parts have substantially aligned upper and lower edges 8D, 8E, 8F and 8G and double folds or creases 8H-8K. These folds are in the central region 8L of the loop parts and are held by the securing means 8C placed at this region. The central region 8L of the back loop part 8B also contains the lateral ends 1A and 1B which are centrally situated in the loop part.

Figure 3:
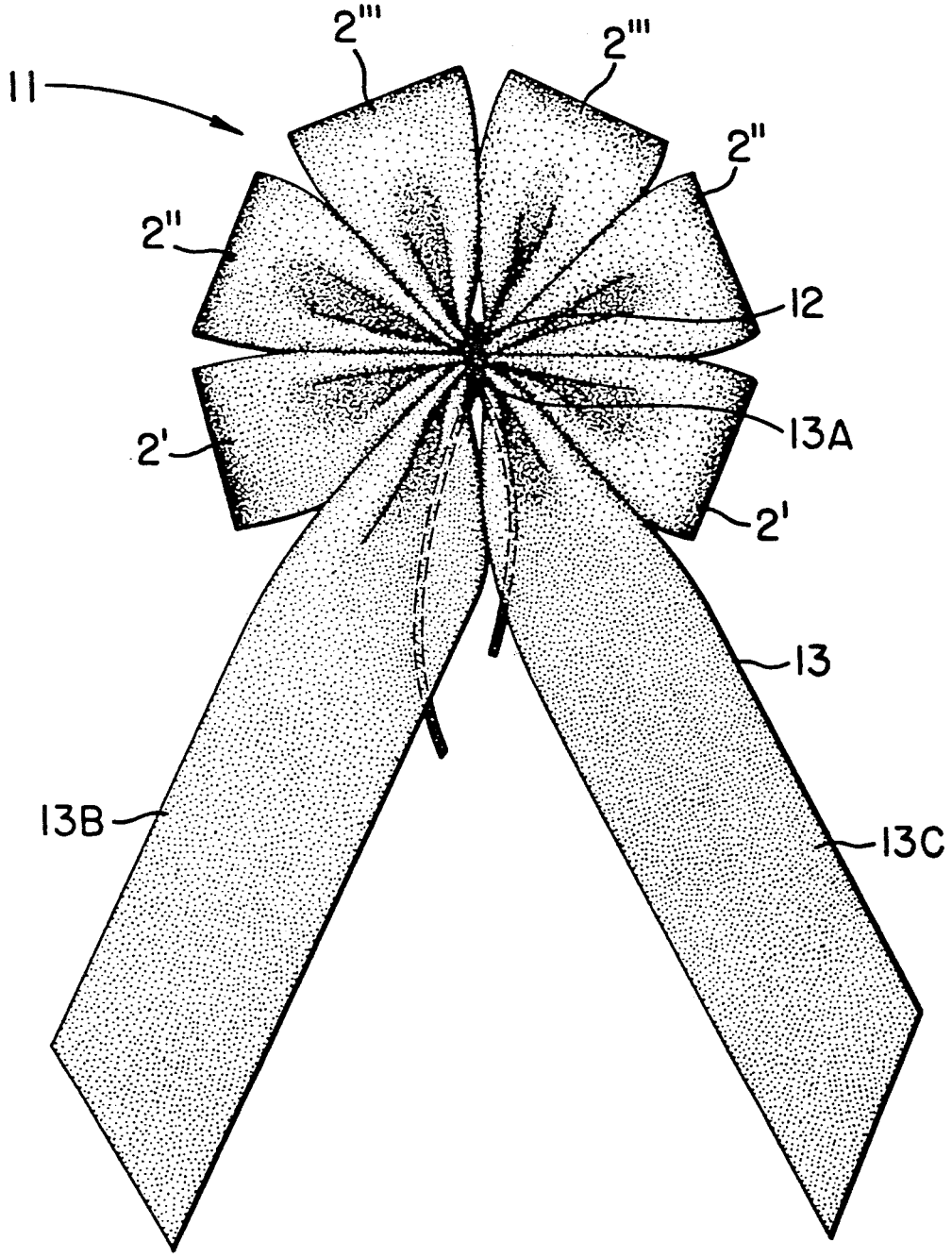
FIG. 3 shows a plurality of the ornament elements of FIG. 2 formed into a bow.

FIG. 3 illustrates an ornament 11 made by assembling three elements 2, shown as 2', 2'' and 2'''. In this case, the central regions 8L of the loops are abutted together. A decorative tie 12 is then wrapped around the central regions 8L of the elements and the elements are suitably adjusted to provide the desired ornament configuration. In the case shown, a streamer element 13 having a double creased central section 13A and tails 13B and 13C has also been added to the bottom of the ornament 11 to provide an additional ornamental effect.

As can be appreciated, in the method of the invention, the loop elements 8 are formed by cutting the tube 4 and not by forming individual strips of material into loops. This avoids having to manipulate individual strips to connect their ends centrally and to align their edges. As a result, the time and manpower needed to form the loops is significantly reduced, thereby providing a more efficient procedure for producing the resultant ornaments.

The method of FIG. 1 can be modified or altered in a variety of ways. In particular, the securing process carried out at the station 5 need not be carried out before the tube is cut, as long as the tube ends are maintained or held in proximity before and after cutting as by the use of pressure fingers or other pressure elements. Also, if the securing step is carried out after the cutting process, it can be incorporated into the creasing step by employing a stronger securing means such as, for example, additional staples, to ensure the folds as well as the ends 1A and 1B remain connected.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A method for use in forming an ornament comprising:

providing a piece of material, said piece of material having lateral ends;

folding the lateral ends of said piece of material over to form a tube of said material having a longitudinal axis;

cutting said tube of material at one or more positions along and transverse to said longitudinal axis and through the extent of said tube of material to form a plurality of separate loops of material;

and jointly creasing opposing loop parts of each loop of material to form an ornament element from each loop of material.

2. A method in accordance with claim 1 further comprising:

assembling said ornament elements into an ornament.

3. A method in accordance with claim 2 wherein:

said assembly step includes abutting and securing together central regions of said ornament elements.

4. A method in accordance with claim 3 wherein:

said ornament is a bow.

5. A method in accordance with claim 1 wherein:

said material has first and second opposing surfaces of different characteristic.

6. A method in accordance with claim 5 wherein:

said first surface is an exposed surface when said material is formed into a tube and comprises a felt material.

7. A method in accordance with claim 2 wherein:

the lateral ends of said material are brought into close adjacent relationship during said folding step and are maintained in close and adjacent relationship during the subsequent steps of said method.

8. A method in accordance with claim 7 wherein:

said lateral ends are secured together when or after said ends are brought into close adjacent relationship.

9. A method in accordance with claim 8 wherein:

said securing of said lateral ends comprises one or more of gluing together said lateral ends, stapling together said lateral ends and stitching together said lateral ends.

10. A method in accordance with claim 8 wherein:

said step of securing said lateral ends together occurs before said cutting step.

11. A method in accordance with claim 8 wherein:

said step of securing said lateral ends together occurs after said cutting step.

12. A method in accordance with claim 8 wherein:

said securing of said lateral ends together comprises permanently securing said lateral ends together.

13. A method in accordance with claim 12 wherein:

said lateral ends are in a first region of one of said opposing loop parts of each loop when that loop is formed;

and said securing of said lateral ends together results in said lateral ends in the first region of each loop being secured to a second region of the opposing part of that loop.

14. A method in accordance with claim 13 wherein:

the first region of each loop part is central of that loop part;

and the second region of each loop part is central of that loop part.

15. A method in accordance with claim 14 wherein:

said loops of material are collapsed.

16. A method in accordance with claim 15 wherein:

said method further comprises one of collapsing said tube of material prior to cutting said material and collapsing each said loop of material after said loop of material is formed to thereby result in said loops of material being in collapsed form.

17. A method in accordance with claim 16 wherein:

said step of collapsing said tube of material is carried out during or after said forming of said tube of material.

18. A method in accordance with claim 1 wherein:

said folding step is carried out by folding said lateral ends toward each other in equal amounts until said lateral ends are in close adjacent relationship.

19. A method in accordance with claim 1 wherein:

said folding step is carried out by folding said lateral ends to a point where said lateral ends overlap.

* * * * *